US007487870B2

(12) United States Patent
Ceulemans

(10) Patent No.: US 7,487,870 B2
(45) Date of Patent: Feb. 10, 2009

(54) DEVICE AND KIT FOR VISUALIZING A CUTTING REGIME OF A DIAMOND, AND A METHOD FOR DETERMINING A CUTTING REGIME

(76) Inventor: Tom Ceulemans, Romestraat 38, Antwerp, Hoboken (BE)

( * ) Notice: Subject to any disclaimer, the term of this patent is extended or adjusted under 35 U.S.C. 154(b) by 415 days.

(21) Appl. No.: 10/576,180

(22) PCT Filed: Nov. 5, 2003

(86) PCT No.: PCT/EP03/12334

§ 371 (c)(1),
(2), (4) Date: Apr. 19, 2006

(87) PCT Pub. No.: WO2005/048764

PCT Pub. Date: Jun. 2, 2005

(65) Prior Publication Data

US 2007/0186918 A1 Aug. 16, 2007

(51) Int. Cl.
*A45C 11/04* (2006.01)

(52) U.S. Cl. ..... 206/6.1

(58) Field of Classification Search ..... 206/6.1
See application file for complete search history.

(56) References Cited

U.S. PATENT DOCUMENTS 5,072,549 A 12/1991 Johnston
5,190,024 A 3/1993 Senayake
5,454,234 A 10/1995 Karmeli
5,552,992 A 9/1996 Hunter
5,637,244 A 6/1997 Erokhin
6,330,523 B1 12/2001 Kacyra et al.
6,495,794 B2 * 12/2002 Shi ..... 219/121.72
2002/0018255 A1 2/2002 Kihara
2005/0197951 A1 * 9/2005 Tolkowsky ..... 705/37
2006/0047585 A1 * 3/2006 Lapa et al. ..... 705/27
2006/0173738 A1 * 8/2006 Marmershteyn ..... 705/14

OTHER PUBLICATIONS

International Search Report issued Jul. 13, 2004 in PCT Application No. PCT/EP 03/12334.

* cited by examiner

*Primary Examiner*—Kara E Geisel
(74) *Attorney, Agent, or Firm*—Knobbe Martens Olson & Bear LLP

(57) ABSTRACT

The present invention relates to a kit for visualising a cutting regime of a rough diamond comprising: (a) a solid, translucent substance into which three dimensional images are marked, said markings indicating: (i) the outer surface of the original rough diamond, (ii) optionally, the internal defects of the rough diamond, said markings indicating the position and shape of said defects with respect of the rough diamond,(iii) optionally, the outer surface of one or more cut diamonds, said markings indicating the position and shape of said cut diamonds with respect of the rough diamond, and (b) solid, physical representations of one or more diamonds indicated by the markings of item (iii), and/or solid, physical representation of the rough diamond, corresponding to the markings of item (i), and/or one or more actual cut diamonds indicated by the markings of item (iii). The present invention further relates to a computer readable medium comprising data regarding the cut stone and the original rough diamond.

16 Claims, 3 Drawing Sheets

DEVICE AND KIT FOR VISUALIZING A CUTTING REGIME OF A DIAMOND, AND A METHOD FOR DETERMINING A CUTTING REGIME

BACKGROUND TO THE INVENTION

Diamonds are formed in the earth's crust under extreme conditions of pressure and temperature. Rough diamond crystals can take millions of years to form. Rough diamonds reach the earth's surface by volcanic eruptions and can be found in volcanic pipes or alluvial depositions (rivers and seas) from where they are mined.

A large proportion of the diamonds found are of industrial quality. They cannot be used as gemstones because they are full of impurities and cracks. Because of the hardness of diamond they are still useful for industrial cutting and drilling tools.

A smaller fraction of the rough diamonds found are of gem stone quality. These stones are cut and polished to be used for precious jewelry or other luxury goods. There is a market for polished diamonds, because of their value and brilliant appearance.

It is clear that the rarity of gem stone quality rough diamonds make them precious. It is the task of a good cutter to cut and polish a rough stone in such a way that the loss of material is minimal and the polished result has the highest possible value.

The value of a polished diamond Is determined by four factors, called the 4 C's namely carat, clarity, colour and cut Each of these factors are judged in a certificate.

Cut A good cut gives a diamond its brilliance, that is the brightness which seems to come from the very heart of a diamond. The angles and finish of any diamond are what determine its ability to handle light, which leads to brilliance. The quality of the "cut" does make a difference in how a diamond looks.

Clarity: Most diamonds contain some inner flaws, or inclusions, that occur during the formation process. The visibility, number and size of these inclusions determine what is called the clarity of a diamond. Diamonds that are clear create more brilliance, and thus are more highly priced. When we speak of a diamond's clarity, we are referring to the presence of identifying characteristics on and within the stone. While most of these characteristics are inherent qualities of the rough diamond and have been present since the earliest stages of the crystal's growth below ground, a few are actually a result of the harsh stress that a diamond undergoes during the cutting process itself.

When the incredible amount of pressure is considered that it takes to create a diamond, it is no surprise that many diamonds have inclusions—scratches, blemishes, air bubbles or non-diamond mineral material—on their surface or inside. Thus, diamonds with no or few inclusions and blemishes are more highly valued than those with less clarity, not just because they are more pleasing to the eye, but also because they are rarer.

Color: Colorless diamonds are the most desirable since they allow the most refraction of light (sparkle). Off-white diamonds absorb light, inhibiting brilliance. When jewelers speak of a diamond's color, they are usually referring to the presence or absence of color in white diamonds. Color is a result of the composition of the diamond, and it never changes over time.

Because a colorless diamond, like a clear window, allows more light to pass through it than a colored diamond, colorless diamonds emit more sparkle and fire. The formation process of a diamond ensures that only a few, rare diamonds are truly colorless. Thus the whiter the color of a diamond, the greater its value.

Carat: A carat is the unit of weight by which a diamond is measured. Because large diamonds are found less commonly than small diamonds, the price of a diamond rises exponentially according to its size. A carat is a unit of measurement. It is the unit used to weigh a diamond. One carat is equal to 200 milligrams, or 0.2 grams. The process that forms a diamond happens only in very rare circumstances, and typically the natural materials required are found only in small amounts. That means that larger diamonds are found less often than smaller ones. Thus, large diamonds are rare and have a greater value per carat. For that reason, the price of a diamond rises exponentially to its size.

The challenge for the cutter is to optimise a diamond towards the four C's. This optimisation process is mainly done by craftsmanship and relies on manual skill and experience of the craftsman. However, this has the disadvantage that the craftsman has to visualize the several possibilities for cutting the diamond, and decide upon the most optimised cutting regime. Furthermore, while the relationships between value and the 4 C's are known, they are non-linear and are interdependent. Where maximizing the value of the rough diamond is important, the craftsman might not recognize the possibility of other, more valuable cutting regimes due to the multiple factors involved. In most cases more than one stone is polished from the same rough, what makes the optimal cutting even harder.

Furthermore, the diamonds resulting from an optimised cutting regime might not be of interest to the client. A client might be prepared to make an additional cost for a diamond of a particular clarity, cut, colour and carat. If the craftsman was able to provide a client with a way to see the rough diamond, and the possibilities for cutting, before the diamond was actually cut, the client would be better served, and the value of the rough diamond would be enhanced.

Furthermore, a client gains satisfaction and pride in owning a diamond. The authentication certificate that presently accompanies a diamond indicates certain measurable parameters of the diamond, and is almost as important as the diamond itself in reassuring the owner of its value. Another parameter which is not indicated on the certificate, but which can be of equal value to the client, is the history of the diamond. A client would be further reassured to know from which rough stone the diamond came and how the diamond was optimised for cutting and polishing. Furthermore, the value of a diamond accompanied by this information would be enhanced over the same diamond lacking such information.

AIMS OF THE INVENTION

It is an aim of the invention to provide a method for optimising the cutting of a rough diamond.

It is a further aim of the invention to provide a means to preview one or more cutting regimes in a rough diamond, before the diamond is cut.

It is further an aim of the invention to provide a means for the owner of a cut diamond to see from which rough diamond the cut diamond came, and the cutting regime used thereon.

SUMMARY OF THE INVENTION

In a first embodiment, the present invention relates to a kit for visualising a cutting regime of a rough diamond comprising:

(a) a solid, translucent substance into which three dimensional images are marked, said markings indicating:
  (i) the outer surface of the original rough diamond,
  (ii) optionally, the internal defects of the rough diamond, said markings indicating the position and shape of said defects with respect of the rough diamond,
  (iii) optionally, the outer surface of one or more cut diamonds, said markings indicating the position and shape of said cut diamonds with respect of the rough diamond, and
(b) solid, physical representations of one or more diamonds indicated by the markings of item (iii), and/or
solid, physical representation of the rough diamond, corresponding to the markings of item (i), and/or
one or more actual cut diamonds indicated by the markings of item (iii).

In another embodiment, the present invention relates to a kit for visualising a cutting regime of a rough diamond comprising:

(a) a hologram depicting markings which indicate:
  (i) the outer surface of the original rough diamond,
  (ii) optionally, internal defects of the rough diamond, said markings indicating the position and shape of said defects with respect of the rough diamond,
  (iii) optionally, the outer surface of one or more cut diamonds, said markings indicating the position and shape of said cut diamonds with respect of the rough diamond,
(b) solid, physical representations of one or more diamonds, said diamonds corresponding to the markings of item (iii), and/or
solid, physical representation of the rough cut diamond, corresponding to the markings of item (i), and/or
one or more actual cut diamonds indicated by the markings of item (iii)

In another embodiment, the present invention relates to a device for visualising a cutting regime of a rough diamond comprising a solid, translucent substance into which three dimensional images are marked, said markings indicating:

(i) the outer surface of the original rough diamond,
(ii) optionally, internal defects of the rough diamond, said markings indicating the position and shape of said defects with respect of the rough diamond, and
(iii) optionally, the outer surface of one or more cut diamonds, said markings indicating the position and shape of said cut diamonds with respect of the rough diamond.

In another embodiment, the present invention relates to a kit as described above, wherein the shape of said solid, translucent substance is a cube, sphere or box.

In another embodiment, the present invention relates to a kit as described above, wherein the shape of said solid, translucent substance is the same as that of the outer surface of the rough diamond, with or without the features of any of items (i), (ii), and/or (iii).

In another embodiment, the present invention relates to a kit as described above, further comprising a computer readable storage medium on which data regarding one or more of the following is stored: certification of the diamond, history of the stone, history of the mine, history of manufacturing, history of trading.

In another embodiment, the present invention relates to a kit as described above, wherein said solid, translucent substance is glass or crystal.

In another embodiment, the present invention relates to a kit as described above, wherein solid, physical representations of item (b) are made of glass or crystal.

In another embodiment, the present invention relates to a kit as described above wherein solid, physical representations of item (b) further comprise markings which indicate the three dimensional boundaries of defects and/or where the outer contour of the rough diamond touches that of the cut diamond.

In another embodiment, the present invention relates to a kit as described above, wherein a solid translucent substance of (a) is absent.

In another embodiment, the present invention relates to a method for determining a cutting regime of a rough diamond, comprising the steps of:

(a) obtaining a three dimensional numerical representation of the rough diamond,
(b) obtaining a three dimensional numerical representation of the defects therein,
(c) changing the positions, sizes and orientations of models of one or more diamonds, so that the maximum value of the collection of diamonds so optimized is obtained, said value based on the clarity, cut, colour and carat.

In another embodiment, the present invention relates to a method for determining a cutting regime of a rough diamond, comprising the steps of:

(a) obtaining a three dimensional numerical representation of the rough diamond,
(b) obtaining a three dimensional numerical representation of the defects therein,
(c) placing a model of a cut diamond therein,
(d) scaling up the model until said model touches an outer surface, or defect
(e) translating and/or rotating the model,
(f) repeating steps (d) to (f) until no further scaling-up is possible,
(g) storing the size and position of the model,
(h) repositioning the model of step (c), and repeating steps (d) to (h), until no larger model is found,
(i) obtaining the size and co-ordinates of the largest model by comparing the sizes stored in step (g), and
(j) repeating steps (c) to (i) in order to determine the size and position of subsequent models, wherein the scaling of step (d) is also terminated upon touching any of the previous model(s) determined step (i).

In another embodiment, the present invention relates to a method for determining a cutting regime of a rough diamond, comprising the steps:

(a) obtaining a three dimensional numerical representation of the rough diamond,
(b) obtaining a three dimensional numerical representation of the defects therein,
(c) generating a population of configurations,
(d) calculating the maximum scale factor for each configuration in the population,
(e) creating a new population based on the results of the first population,
(f) repeating steps (d) to (f) until the value of the cut stones converges to a maximum, and
(g) obtaining the size and co-ordinates of the cut diamonds which provide the maximum value of cut diamonds.

In another embodiment, the present invention relates to a computer program stored on a computer readable medium capable of performing a method as described above.

DETAILED DESCRIPTION OF THE INVENTION

One embodiment of the present invention is a device comprising a solid, translucent substance into which a three dimensional image of the outer surface of the original rough diamond is marked such that said image can be visualized.

The substance may be any solid translucent substance and includes, but is not limited to glass, crystal, polycarbonate, polypropylene, resin, plastic. The substance may be clear or translucent. The substance may be colourless or coloured.

In one embodiment of the invention, the device has a regular shape such as a cube, a sphere, a cylinder, a dome, a pyramid, an egg, a prism, a box. Alternatively, the device might have an irregular shape, wherein said irregular shape is not the same as the outer surface of the original rough diamond.

The marking process indicates the three dimensional image of the outer surface of the original rough diamond within the device, without changing the outer shape of the device. According to the invention, the marking process can change the colour of the substance at the point of the mark. Alternatively, the marking process can change the opacity of the substance at the point of the mark. The marking process leads to any change in the substance at the position of the mark, so leading to an indication of the three dimensional image of the outer surface of the original rough diamond.

Means for marking solid, translucent substances beneath their surfaces are known in the art, and include, but are not limited to laser, X-ray, ultra-sound and light.

According to one aspect of the invention, the marks form a pattern such as a see-through wire mesh, point cloud, or a colour wall in the shape outer surface of the original rough diamond.

In one aspect of the invention, the markings are made using a scientific class laser driven by a computer software program, wherein the solid substance is a flawless piece of optically clear solid crystal or glass. A focused laser beam is programmed to penetrate the crystal and create a miniature dot within. Following a precise sequence, tens of thousands of these dots form an exquisite design.

Light is actually an electromagnetic wave and thus has an electric field. A laser beam, also known as coherent light creates an electric field greater than 10 million volts per centimeter. The focus of the laser beam creates "free" or unattached electrons. The "free" electrons, accelerated by the electric field created by the laser beam causes the high energy electrons to collide with atoms and ions in the focus area. As the process continues it causes a chain reaction and produces about 1 million trillion free electrons per cubic centimeter in about 1 trillionth of a second. This phenomenon is called "multiphoton absorption."

The laser is focused to a spot (about one-tenth of the diameter of a human hair) within a block of optically perfect crystal or glass. The laser then emits a short pulse beam (a few billionths of a second) and produces a tiny micro crack, which provides a marking. The system then perfectly aligns and positions tens of thousands of additional micro cracks to create 2 or 3 dimensional images. Although, the laser generates power densities of 10 billion watts per square centimeter, the surface of the crystal is not damaged due to the highly transparent nature of optically perfect crystal. The resulting images appear to float within the crystal.

It is another aspect of the invention that the shape of the outer surface of the rough diamond marked into the device is the same size as the original rough diamond. It is another aspect of the invention that the shape of the outer surface of the rough diamond marked into the device is proportionally larger or smaller than the shape of the original rough diamond In another embodiment of the invention, the outer surface of the device has the same shape as the outer surface of the original rough diamond.

It is another aspect of the invention that the device further comprises a base. It is another aspect of the invention that the device further comprises a grasping means. It is another aspect of the invention that the device further comprises an identification means, such as a plate, or region to receive embossed, indented, or printed lettering. Said identification may be on the surface of the device or may be marked within the device.

It is another aspect of the invention that the device further comprises additional markings which indicate the internal defects (e.g. inclusions) of the rough diamond. Said markings indicate the position and shape of said defects with respect of the rough diamond. The markings can be of any type as disclosed herein. Preferably the internal defect markings are of a different colour and/or opacity to that of the outer surface of the original rough diamond.

It is another aspect of the invention that the device further comprises additional markings which indicate the outer surface of one or more cut diamonds. Said markings indicate the position and shape of said cut diamonds with respect of the rough diamond. The markings can be of any type as disclosed herein. Preferably the cut diamond markings are of a different colour and/or opacity to that of the outer surface and internal defects of the original rough diamond.

Thus, the device of the present invention provides a scaled, three-dimensional indication of the rough diamond, the defects therein and the diamonds cut therefrom. One or more devices may indicate several possible cutting regimes which can be forwarded to clients before the rough diamond is actually cut. The device may also provide a craftsman with an indication of the most cost effective cutting regime. The device may also provide a diamond owner with an indication of the origin of the diamond, which might enhance the value of the actual diamond. Since the possibility is provided to add text information to the device, either floating inside or on the surface, other certification information may be added thereto such as logo of the company that polished the stone, weight of the rough and the polished stone(s), origin of the stone, certificate number, the grading (4 C's) results.

Another embodiment of the present invention is data that allows the visualization of a cutting regime of a rough diamond, comprising an indication of the outer surface of the original rough diamond. Said data may further indicate internal defects of the rough diamond, with an indication of the position and shape of said defects with respect of the rough diamond. Said data may further indicate, the outer surface of one or more cut diamonds, with an indication of the position and shape of said cut diamonds with respect of the rough diamond.

Another embodiment of the present invention is a hologram for visualising a cutting regime of a rough diamond, said hologram which depicting the outer surface of the original rough diamond. Said hologram may further indicate internal defects of the rough diamond, said markings indicating the position and shape of said defects with respect of the rough diamond. Said hologram may further indicate the outer surface of one or more cut diamonds, said markings indicating the position and shape of said cut diamonds with respect of the rough diamond.

Another embodiment of the present invention is a kit comprising a device and/or hologram as mentioned herein together with one or more actual cut-diamond(s), said cut diamond corresponding to a cut diamond whose shape is marked in the solid substance.

Another embodiment of the present invention is a kit comprising a device and/or hologram as mentioned herein together with one or more physical representations of a cut-diamond(s), said representation corresponding to a cut diamond whose shape is marked in the solid substance. The physical representation is known herein as a 'jewel avatar'.

According to the invention, a jewel avatar represents a diamond cut from the rough stone, and indicates the shape and size of the cut diamond to scale. Its position in the rough diamond is indicated by one of the shapes marked in the solid translucent substance of the device.

Another embodiment of the present invention is a kit comprising a device and/or hologram as mentioned herein and one or more physical representations of a rough diamond, said representation corresponding to the rough diamond whose shape is marked in the solid substance. The physical representation is known herein as a 'rough diamond model'

The jewel avatar or rough diamond model may be made from any solid material, translucent or opaque. Examples of materials include, but are not limited to glass, polypropylene, polycarbonate, metal, wood, resin.

Methods for making jewel avatars and rough diamond models are well known and include laser cutting, milling, casting and molding.

A kit of the invention which provides a tactile indication of a cut diamond in the form of a jewel avatar, and/or a rough diamond model, an indication of the rough diamond from which it was cut, its position therein, and defects, allows a client to view a diamond before it is cut. A kit of the invention further allows a purchaser or owner of a cut diamond to have an indication of the rough diamond from which it originated and optionally the cutting regime used therein.

Another embodiment of the present invention is a kit comprising a device as described herein together with a computer readable medium (CRM). Said CRM may be any such as, for example, a CD, DVD, floppy disc, memory card, optical disk. Said CRM may also be read by reading devices such as DVD players, games machines, pocket organisers and CD players.

It is an aspect of the invention that the CRM contains information such as

- a numerical representation of the rough diamond, defects and diamonds cut therefrom
- information on the mine where the stone was found,
- general information on the nature of diamond (the four Cs, properties, the mining, the polishing, and the marketing)
- information on the original rough stone (images, carat)
- information on how the stone was studied and optimized.
- information on the sawing and cutting.
- images, movie sequences, text relating to the above.

A kit of the invention comprising a CRM, provides an added value to the diamond. Said kit can provide much more information than is contained in a standard authentication certificate. Said kit also provides reassurance to the owner of a diamond regarding its value. Said kit can also enhance the value of a diamond, by providing the owner with a marketing tool at such a time as when he wishes to sell the diamond.

The three dimensional (3D) image of the outer surface of the original rough diamond that is marked into, or forms the shape of a device of the invention, or is used to make a hologram of the invention is derived from a process of imaging the rough diamond. The imaging process creates a 'virtual model' of the rough diamond.

Several techniques are available to create virtual models of objects. A variety of commercially available technologies can be used to digitise physical objects.

The process of 3D digitizing usually comprises a sensing phase followed by a reconstruction phase. The sensing phase collects or captures the raw data, usually as a two dimensional (2D) boundary object, or a 3D point cloud. The reconstruction phase is the internal processing of this data into conventional 3D computer aided design (CAD) and animation geometry data such as NURBS, point clouds, mesh representations and polygon sets. Sophisticated reconstruction software packages are available from scanner vendors and 3 rd party software houses.

An example of a method for digitizing an object in three dimensions is Magnetic Resonance Imaging (MRI). MRI is an imaging technique used primarily in medical settings to produce high quality images of the inside of the human body. MRI is based on the principles of nuclear magnetic resonance (NMR), a spectroscopic technique used by scientists to obtain microscopic chemical and physical information about molecules. The technique was called magnetic resonance imaging rather than nuclear magnetic resonance imaging (NMRI) because of the negative connotations associated with the word nuclear in the late 1970's. MRI started out as a tomographic imaging technique, that is it produced an image of the NMR signal in a thin slice through the human body. MRI has advanced beyond a tomographic imaging technique to a volume imaging technique.

The nuclear magnetic resonance phenomenon can be described in a nutshell as follows. If a sample is placed in a magnetic field and is subjected to radio-frequency (RF) radiation (energy) at the appropriate frequency, nuclei in the sample can absorb the energy. The frequency of the radiation necessary for absorption of energy depends on three things: the type of nucleus (e.g. $^{1}H$ or $^{13}C$), the chemical environment of the nucleus and the spatial location in the magnetic field if that field is not uniform This last variable provides the basis for magnetic resonance imaging (MRI).

This technique cannot be used when the gemstone is not mainly made out of atoms with a nuclear spin. For example, diamond cannot be measured.

When one only wants the external 3D contour the internal, structure information can be ignored.

Therefore, according to one aspect of the invention, MRI is used to create a three dimensional image of the outer surface of the original rough diamond Another example of a method for digitizing an object in three dimensions is using a mechanical tracking system. Here the object is probed by a sharp needle. The mechanical displacement of the probe is registered when moving over the objects surface.

Therefore, according to one aspect of the invention, a mechanical tracking system is used to create a three dimensional image of the outer surface of the original rough diamond Another example of a method for digitizing an object in three dimensions is using an optical scanning system. According to this method one can place a rough diamond between a light source (preferentially parallel beam of light) and an imaging system (preferentially a digital camera). A shadow image of the stone is formed on the imaging device. One only needs to store the outer contour of the shadow image (the border between diamond and air). When rotating the stone over 180 degrees with small steps collecting a large number of shadow contours, one is able to reconstruct a 3D digital model of the diamond.

The disadvantage of this optical scanning is that surface holes and some other concave surface features are not registered.

According to one aspect of the invention, an optical system is used to create a three dimensional image of the outer surface of the original rough diamond.

Another example of a method for digitizing an object in three dimensions is using a laser scanning system. One can use a laser beam to scan the surface of the diamond. A point cloud is created and a 3D digital model can be generated.

This method is better than the optical scanning technique mentioned before, but still is not able to detect all surface holes and all other concave surface features in a correct way.

A laser diode and stripe generator is used to project a laser line onto the object. The line is viewed at an angle by cameras so that height variations in the object can be seen as changes in the shape of the line. The resulting captured image of the stripe is a profile that contains the shape of the object.

The resulting point cloud can be used to extract CAD elements or—by using point triangulation—to create a 3D surface model. Additionally, images can be mapped onto the model to get a virtual copy of the real object.

According to one aspect of the invention, a laser scanning system is used to create a three dimensional image of the outer surface of the original rough diamond.

Another example of a method for digitizing an object in three dimensions is using Computer Microtomography (microCT). The best way to detect the exact surface contour including all surface holes and all other concave surface features, is by using a microtomographic scanner (microCT). Microtomography is the high resolution version of a medical CT scanner. Using X-rays one can visualize slices through an object in a non-destructive way. When stacking the different slices one obtains a 3D image of the object including the internal structure. When one only wants the external 3D contour the internal structure information can be ignored.

According to one aspect of the invention, a microCT system is used to create a three dimensional image of the outer surface of the original rough diamond.

The internal defects of a rough diamond may be determined by imaging the rough stone. The imaging may be performed by an suitable technique. Known techniques are:

(a) Using a microscope to locate the position of an internal defect relative to the outer surface of the rough stone. One can first focus on the surface of the stone and then measure how much the focus needs to be moved to get a sharp image of the defect. Using this information it is possible to position the inclusion in the 3D digital model of the outer shape of the rough stone.

(b) using MRI to non-invasively locate defects as described above.

(c) using micro CT as described above

In another embodiment of the invention, microCT is used to create a three dimensional image of the outer surface of the original rough diamond and to create a three dimensional image of the defects of original rough diamond.

The inventors have found that microCT provides accurate three dimensional co-ordinates of the outer surface of the original rough diamond, and/or of the defects therein. Furthermore, the process of obtaining said co-ordinates is much faster, automated and hence more economical than the other methods. The combined cost saving and accuracy of using microCT provides a preferred method for obtaining three dimensional image data for the present invention.

Once a digital 3D model of the rough diamond is available including the internal defects, a method can be used to calculate the best solution for cutting and polishing. The algorithm calculates different solutions for obtaining the highest value of polished stones. Optimization is done according to the collective value of the cut diamonds obtained, and not by size of the stones. The method accounts for all the aspects of the valuing a polished diamond, including size, colour, clarity, and cut.

One aspect of the present invention is a method for optimizing the cutting regime of a rough diamond, so as to maximize the value of the diamonds so cut.

Another aspect of the present invention is a method for determining a cutting regime of a rough diamond, comprising the steps of:

(a) obtaining a three dimensional numerical representation of the rough diamond, (b) obtaining a three dimensional numerical representation of the defects therein, (c) changing the positions, sizes and orientations of models of one or more diamonds, so that the maximum value of the collection of diamonds so optimized is obtained, said value based on the clarity, cut, colour and carat.

Such an optimization method is not straightforward for a craftsman to perform because of the multiple factors involved in determining the value of a cut diamond, and the fact that in most cases more than one cut diamond is optimized from one rough stone. The relationships between value and clarity, value and cut, value and carat, and value and colour are not linear, therefore, judging the optimum cut would be a difficult task due to the inter-related, irregular and multiple variables. Such a task would be complicated several fold when more than one diamond is required to be optimized. Since a method of the invention is able to optimize the cutting regime for one or more diamonds starting from only a numerical representation of the outer surface of the rough diamond, and a numerical representation of the defects therein, a method of the invention is faster, convenient and more cost-effective than those of the art.

Different approaches are possible in the 3D optimisation methods according to the invention. One can place a small polished model inside the rough stone. Then the model of the polished stone can be enlarged until the contour hits the outer contour of the mother crystal or one of its inclusions. Then the stone can be translated and/or rotated in a position where the scaling again can be enlarged. This iterative process allows the largest polished model inside the rough to be determined, taking into account the clarity. It is important to start this optimization process at different locations inside, to avoid to run into local optima. Once the main stone is found, the algorithm can be repeated in the rest volume to find a second, third, or further polished stones.

Another embodiment of the present invention is a method for optimizing the cutting regime of a rough diamond, so as to maximize the value of the diamonds so cut, comprising the steps of:

(a) obtaining a 3D numerical representation of the rough diamond, (b) obtaining a 3D numerical representation of the defects therein, (c) placing a model of a cut diamond therein, (d) scaling up the model until said model touches an outer surface, or a defect (e) translating and/or rotating the model, (f) repeating steps (d) to (f) until no further scaling-up is possible, (g) storing the size and position of the model, (h) repositioning the model of step (c), and repeating steps (d) to (h), until no larger model is found, (i) obtaining the size and co-ordinates of the largest model by comparing the sizes stored in step (g)

(j) repeating steps (c) to (i) in order to determine the size and position of subsequent models, wherein the scaling of step (d) is also terminated upon touching any of the previous model(s) determined in step (i)

A more advanced approach for optimization methods is the use of a genetic growth method. According to the genetic growth method, the starting point is a population of sets of polished stones inside the rough diamond. A population contains several configurations and each configuration consists of the position, size and orientation of one or more cut diamond models. For each configuration the maximum growth factor is calculated. From the results of the first population, a new generation is created based on the best individuals.

Another embodiment of the present invention is a method for optimizing the cutting regime of a rough diamond, so as to maximize the value of the diamonds so cut comprising the steps of:

(a) obtaining a 3D numerical representation of the rough diamond,
(b) obtaining a 3D numerical representation of the defects therein,
(c) generating a population of configurations,
(d) calculating the maximum scale factor for each configuration in the population,
(e) calculating a new population based on the results of the first population,
(f) repeating steps (d) to (f) until the value of cut stones converges to a maximum,
(g) obtaining the size and co-ordinates of the cut diamonds which provide the maximum value of cut diamonds.

Another aspect of the invention is a computer program stored on a computer readable medium capable of performing a method the invention.

The present invention as disclosed herein is described in relation to diamonds, however, it is self evident that the invention may be applied to the cutting of, and adding value to, any gem stone.

FIGURES

FIG. 1: A mesh representation of a rough diamond, and four cut and polished diamonds, marked into a translucent solid substance.

FIG. 2: A representation of a rough diamond, and four cut and polished diamonds formed from a translucent solid substance, wherein the shape of the outer surface of the translucent solid substance is the same as that of the rough diamond.

FIG. 3: Four physical objects (jewel avatars) which represent the four cut and polished diamonds obtainable from the rough diamond indicated FIGS. 1 and 2.

FIG. 4: A representation of a rough diamond formed from an opaque solid substance, wherein the shape of the outer surface of the opaque solid substance is the same as that of the rough diamond.

FIG. 5: A device of the invention comprising a mesh representation of a rough diamond marked into a translucent solid substance.

FIG. 6: A kit according to the invention comprising a mesh representation of a rough diamond, and four cut and polished diamonds, marked into a translucent solid substance, together with a jewel avatar.

DETAILED DESCRIPTION OF THE FIGURES

FIG. 1 depicts a box-shaped, translucent, solid substance 1, into which a three dimensional representation of the surface of a rough cut diamond is marked, the outline of which is indicated by a dotted line 2. Further marked into the solid substrate 1, are the positions, sizes and orientations of four cut diamonds 3, 4, 5, 6, said markings indicating the edges of said cut diamonds. Further marked as a dot, is one of several small impurities 7; said impurities limit the size of the cut diamond. Further marked is a boundary 8 where a polished stone 4 touches the surface of the rough stone.

FIG. 2 depicts a translucent solid substance 9, the shape of which is the same as the surface of rough cut diamond 2 it represents. The outline of the shape is indicated by a dotted line. Further marked into the solid substrate 9, are the positions, sizes and orientations of four cut diamonds 3, 4, 5, 6, said markings indicating the edges of said cut diamonds. Further marked is one of several small impurities 7 which limit the size of the cut diamond. Further marked is a boundary 8 where a polished stone 4 touches the surface of the rough stone.

FIG. 3 depicts four physical jewel avatars 10, 11, 12, 13 of the diamonds obtainable from a rough cut diamond 2 shown in FIGS. 1 and 2. Said jewel avatars correspond to the cut diamonds indicated in FIGS. 1 and 2 by reference signs 3, 4, 5 and 6 respectively. Further marked in the jewel avatars is a boundary 15 where a polished stone touched the surface of the rough stone 15.

Figure 1:
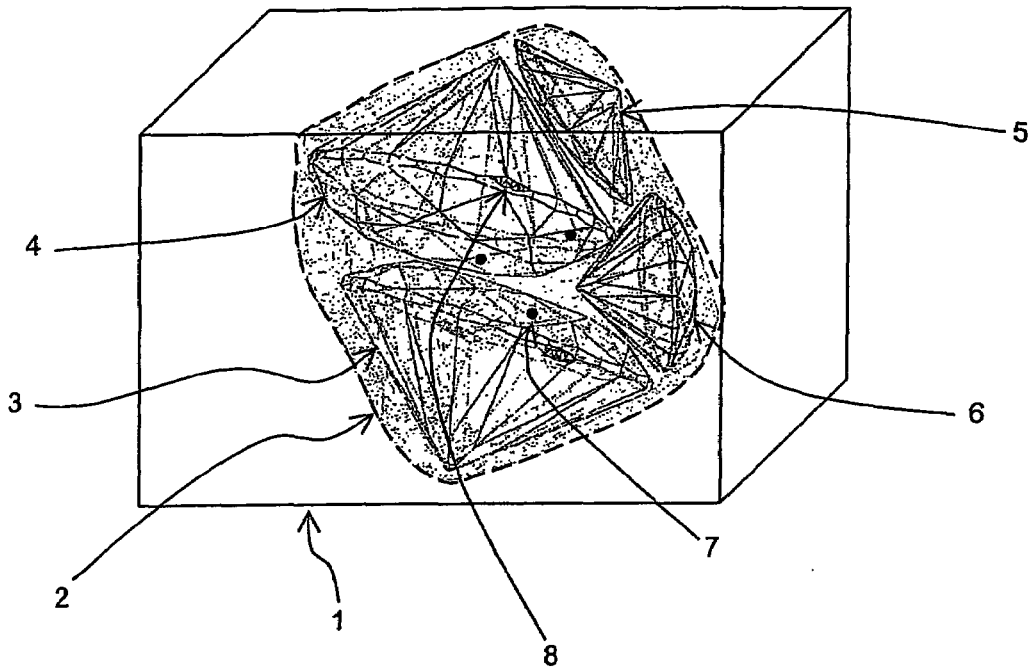
Figure 2:
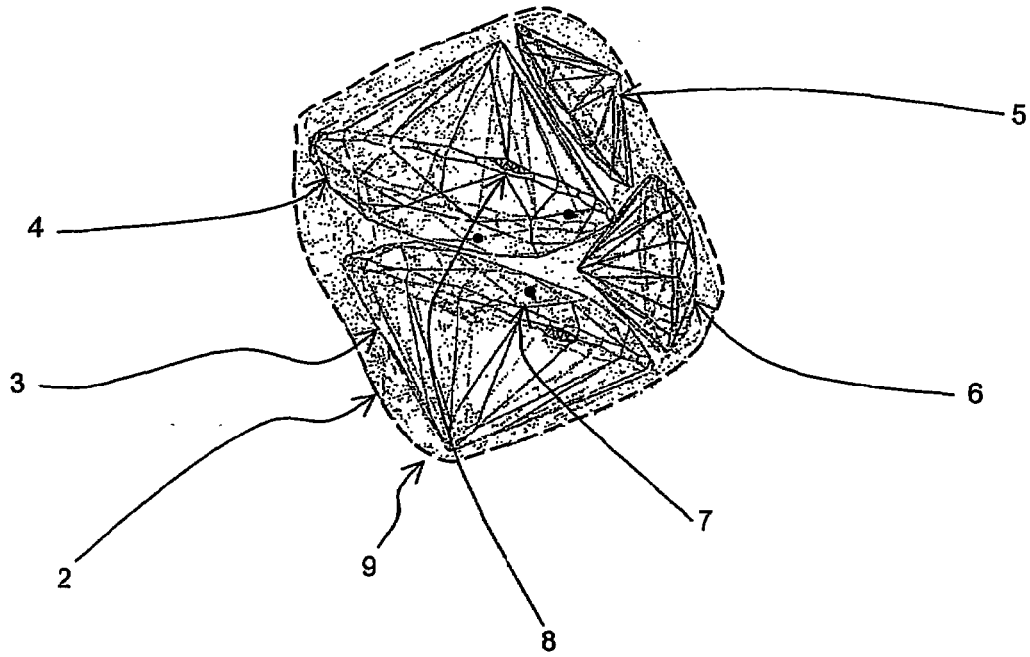
Figure 3:
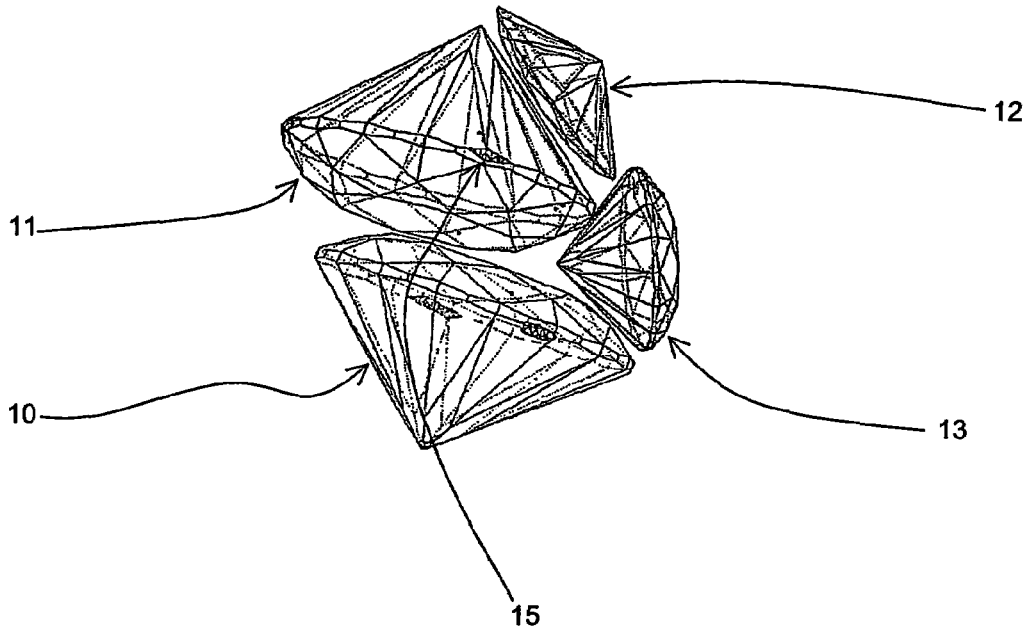
Figure 4:
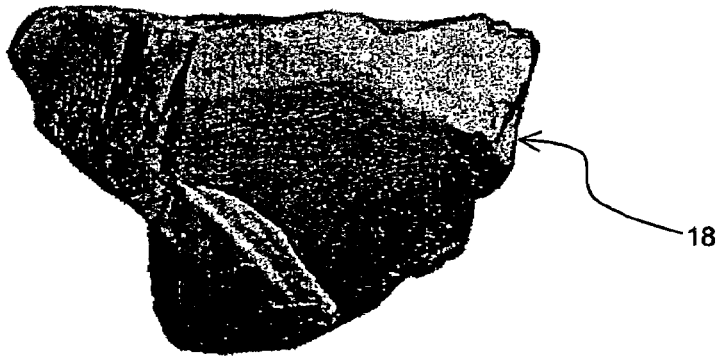
FIG. 4 depicts a rough diamond model 18, made, in this instance from a solid opaque material.
Figure 5:
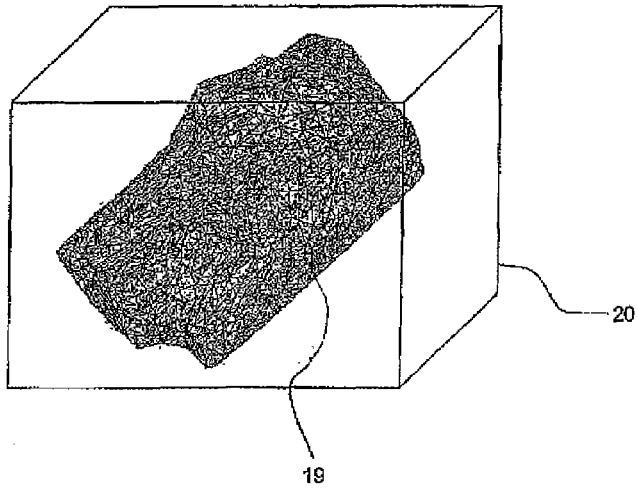
FIG. 5 depicts a device according to the invention comprising a box-shaped translucent solid substance 20 into which a three dimensional representation of the surface of a rough cut diamond has been marked 19
Figure 6:
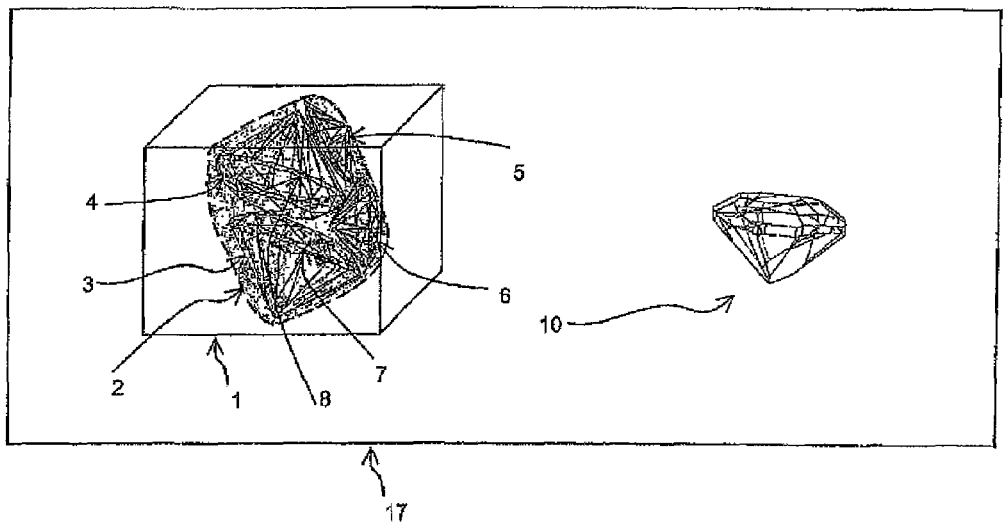

FIG. 6 depicts a kit 17, according to the invention comprising box-shaped, translucent, solid substance 1, into which a three dimensional representation of the surface of a rough cut diamond is marked 2. Further marked into the solid substrate 1, are the positions, sizes and orientations of four cut diamonds 3, 4, 5, 6, said markings indicating the edges of said cut diamonds. Further marked are a small impurity 7 which limits the size of the cut diamond, and a boundary 8 where a polished stone 4 touches the surface of the rough stone. The kit further comprises a jewel avatar 10, a physical representation of the cut diamond indicated by reference sign 3. Alternatively, instead of the jewel avatar 10, the kit may comprise the actual cut diamond indicated by reference sign 3. Alternatively, the kit may comprise a rough diamond model 18, instead of a jewel avatar 10.

The invention claimed is:

1. A kit for visualizing a cutting regime of a rough diamond, the kit comprising:

(a) a solid, translucent substance into which three dimensional images are marked, said markings indicating:
(i) the outer surface of the original rough diamond;
(ii) if present in said rough diamond, the internal defects of the rough diamond, said markings indicating the position and shape of said defects with respect to the rough diamond; and
(iii) the outer surface of one or more cut diamonds, said markings indicating the position and shape of said cut diamonds with respect to the rough diamond; and
(b) at least one of solid, physical representations of one or more diamonds indicated by the markings of item (iii);
solid, physical representation of the rough diamond, corresponding to the markings of item (i); and
one or more actual cut diamonds indicated by the markings of item (iii).

2. A kit according to claim 1, wherein the shape of said solid, translucent substance is a cube, sphere or box.

3. A kit according to claim 1, wherein the shape of said solid, translucent substance is substantially the same as that of the outer surface of the rough diamond.

4. A kit according to claim 1, further comprising a computer readable storage medium on which data regarding one or more of the following is stored: certification of the diamond, history of the stone, history of the mine, history of manufacturing, history of trading.

5. A kit according to claim 1, wherein said solid, translucent substance comprises glass or crystal.

6. A kit according to claim 1, wherein solid, physical representations of item (b) comprise glass or crystal.

7. A kit according to claim 1, wherein solid, physical representations of item (b) further comprise markings which indicate the three dimensional boundaries of defects and/or where the outer contour of the rough diamond touches that of the cut diamond.

8. A kit for visualizing a cutting regime of a rough diamond, the kit comprising:

(a) a hologram depicting markings which indicate:

(i) the outer surface of the original rough diamond;

(ii) if present in said rough diamond, internal defects of the rough diamond, said markings indicating the position and shape of said defects with respect to the rough diamond; and (iii) the outer surface of one or more cut diamonds, said markings indicating the position and shape of said cut diamonds with respect to the rough diamond; and (b) at least one of solid, physical representations of one or more diamonds, said diamonds corresponding to the markings of item (iii);

solid, physical representation of the rough diamond, corresponding to the markings of item (i); and one or more actual cut diamonds indicated by the markings of item (iii).

9. A kit according to claim 8, further comprising a computer readable storage medium on which data regarding one or more of the following is stored: certification of the diamond, history of the stone, history of the mine, history of manufacturing, history of trading.

10. A kit according to claim 8, wherein solid, physical representations of item (b) comprise glass or crystal.

11. A kit according to claim 8, wherein solid, physical representations of item (b) further comprise markings which indicate the three dimensional boundaries of defects and/or where the outer contour of the rough diamond touches that of the cut diamond.

12. A device for visualizing a cutting regime of a rough diamond, the device comprising a solid, translucent substance into which three dimensional images are marked, said markings indicating:

(i) the outer surface of the original rough diamond;

(ii) if present in said rough diamond, internal defects of the rough diamond, said markings indicating the position and shape of said defects with respect to the rough diamond; and (iii) the outer surface of one or more cut diamonds, said markings indicating the position and shape of said cut diamonds with respect to the rough diamond.

13. A device according to claim 12 wherein the shape of said solid, translucent substance is a cube, sphere or box.

14. A device according to claim 12 wherein the shape of said solid, translucent substance is substantially the same as that of the outer surface of the rough diamond.

15. A device according to claim 12 further comprising a computer readable storage medium on which data regarding one or more of the following is stored: certification of the diamond, history of the stone, history of the mine, history of manufacturing, history of trading.

16. A device according to claim 12 , wherein said solid, translucent substance comprises glass or crystal.

* * * * *